US005992434A

United States Patent [19]

Berlin et al.

[11] Patent Number: 5,992,434

[45] Date of Patent: Nov. 30, 1999

[54] ENLARGED TIP FOR CANE

[76] Inventors: Leonard A. Berlin, 9 Northwood Ct., Dix Hills, N.Y. 11746; Arthur B. Greene, 217 Sundance Rd., Stamford, Conn. 06905

[21] Appl. No.: 09/009,024

[22] Filed: Jan. 20, 1998

[51] Int. Cl.[6] ..... A45B 1/00

[52] U.S. Cl. ..... 135/77; 135/66; 135/67

[58] Field of Search ..... 135/65–67, 77, 135/78, 82, 89, 86; D3/7–10, 17

[56] References Cited

U.S. PATENT DOCUMENTS

| | | | |
|---|---|---|---|
| D. 378,551 | 3/1997 | Shelnutt | D3/17 |
| 2,910,995 | 11/1959 | Jacuzzi | 135/65 |
| 3,040,757 | 6/1962 | Smith | 135/65 |
| 3,251,372 | 5/1966 | Smith | 135/65 |
| 3,731,920 | 5/1973 | Matsuda | 135/64 X |
| 3,741,226 | 6/1973 | Urban | 135/62 |
| 4,098,283 | 7/1978 | Tritle | 135/77 |
| 4,135,536 | 1/1979 | Willis | 135/84 |
| 4,141,375 | 2/1979 | Tykwinski | 135/66 |
| 4,562,851 | 1/1986 | Frank | 135/78 |
| 4,601,302 | 7/1986 | Breen et al. | 135/66 |
| 4,630,626 | 12/1986 | Urban | 135/84 |
| 4,881,564 | 11/1989 | Fetterman | 135/82 |
| 4,899,771 | 2/1990 | Wilkinson | 135/77 |
| 5,178,176 | 1/1993 | Fetterman | 135/86 |
| 5,238,013 | 8/1993 | Battiston et al. | 135/75 |
| 5,301,704 | 4/1994 | Brown | 135/78 |
| 5,307,828 | 5/1994 | Gardner | 135/82 |
| 5,331,989 | 7/1994 | Stephens | 135/65 |
| 5,392,801 | 2/1995 | Hannoosh | 135/65 |
| 5,409,029 | 4/1995 | Davis | 135/68 |
| 5,727,584 | 3/1998 | Stanec | 135/77 |
| 5,826,606 | 10/1998 | Davenport | 135/82 |

*Primary Examiner*—Beth Aubrey

*Attorney, Agent, or Firm*—David P. Gordon; David S. Jacobson; Thomas A. Gallagher

[57] ABSTRACT

An enlarged and weighted tip for replacing a multi-pod tip of a cane and for receiving a lower end of the cane and for allowing the cane to stand by itself. The tip includes a body portion that is shaped like a frustrum of substantially a pyramid. The body portion has a cavity therein that is disk-shaped and is disposed axially between the bore in the top surface of the body portion and the base of the body portion, parallel thereto. The tip further includes a plate that completely fills the cavity in the body portion and provides structural integrity, prevents rupturing of the base of the body portion caused by weight bearing on the cane tending to push it downwardly, and which adds sufficient weight to lower the center of gravity enabling the cane to stand by itself.

25 Claims, 2 Drawing Sheets

ENLARGED TIP FOR CANE

BACKGROUND OF THE INVENTION

1. Field of the Invention

The present invention relates to a tip for a cane or the like. More particularly, the present invention relates to an enlarged and weighted tip for replacing a multi-pod tip of a cane or the like.

2. Description of the Prior Art

Numerous innovations for tips for canes or the like have been provided in the prior art that will be described. Even though these innovations may be suitable for the specific individual purposes to which they address, however, they differ from the present invention.

FOR EXAMPLE, U.S. Pat. No. Des. 378,551 to Shelnutt teaches the ornamental design for a crutch tip.

ANOTHER EXAMPLE, U.S. Pat. No. 4,881,564 to Fetterman teaches a crutch tip including an integrally fabricated tubular receiver for a crutch shaft and having on its lower end an enlarged depending skirt. Firmly secured conformably within the skirt are a rigid plate immediately beneath the receiver, an absorption or damping pad immediately beneath the plate, and a ground engageable tread piece immediately beneath the absorption pad, which tread piece includes depending projections for receiving and flexing about small articles on the ground while maintaining traction with the ground.

STILL ANOTHER EXAMPLE, U.S. Pat. No. 5,178,176 to Fetterman teaches a crutch tip for installation on the lower end of a crutch shaft for engagement with an underlying supporting surface. The crutch tip includes a first material having a first coefficient of friction with respect to the supporting surface and a second material having a second coefficient of friction with respect to the supporting surface. The crutch tip generally includes a radial outer skirt, a ring portion radially inwardly of the skirt, and a center portion. The ring portion may be formed from the first material and the outer skirt may be formed from the second material.

YET ANOTHER EXAMPLE, U.S. Pat. No. 5,301,704 to Brown teaches a walking cane that has an enlarged foot piece, formed with a convex arcuate lower surface, that functions as a small rocker. One, or two, rows of spikes extend downwardly from the arcuate surface, for penetration and gripping of icy surfaces. An elastomeric, resilient pad may be attached to the arcuate lower surface of the foot piece, to adapt the cane for use on normal walking surfaces, such as carpets, hard floors, and outdoor sidewalks. The pad has a series of sockets that fit onto the spikes for retention of the pad on the foot piece. The arcuate surface contour on the foot piece is advantageous in that it enables the spikes or resilient pad to maintain a non-slip, rocking engagement with the walking surface during the entire walking stride, i.e., while the person is using the cane to partially support his or her own weight during forward motion of the person's body.

FINALLY, YET ANOTHER EXAMPLE, U.S. Pat. No. 5,409,029 to Davis teaches a crutch tip assembly that includes a crutch tip base with a laterally protruding lip adjacent a base bottom surface and a resilient boot having the shape of a rocker. The boot defines a mounting cavity for snugly receiving the base bottom surface and the lip for holding the boot on the base. The boot has a sole with a bottom surface for contacting the ground and a tip surface in the cavity directed towards the base bottom surface. Protruding portions are positioned between the base bottom surface and the sole top surface for providing resilient cushioning between the sole top surface and the base bottom surface. Sidewall cavities are located around the perimeter of the boot allowing for lateral compression and reexpansion.

It is apparent that numerous innovations for tips for canes or the like have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an enlarged and weighted tip for replacing a multi-pod tip of a cane or the like that avoids the disadvantages of the prior art.

ANOTHER OBJECT of the present invention is to provide an enlarged and weighted tip for replacing a multi-pod tip of a cane or the like that is simple and inexpensive to manufacture.

STILL ANOTHER OBJECT of the present invention is to provide an enlarged and weighted tip for replacing a multi-pod tip of a cane or the like that is simple to use.

BRIEFLY STATED, YET ANOTHER OBJECT of the present invention is to provide an enlarged and weighted tip for replacing a multi-pod tip of a cane and for receiving a lower end of the cane and for allowing the cane to stand by itself. The tip includes a body portion that is shaped like a frustrum of substantially a pyramid. The body portion has a cavity therein that is disk-shaped and is disposed axially between the bore in the top surface of the body portion and the base of the body portion, parallel thereto. The tip further includes a plate that completely fills the cavity in the body portion and provides structural integrity, prevents rupturing of the base of the body portion caused by weight bearing on the cane tending to push it downwardly, and which adds sufficient weight to lower the center of gravity enabling the cane to stand by itself.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures on the drawing are briefly described as follows.

LIST OF REFERENCE NUMERALS UTILIZED IN THE DRAWING

Figure 1:
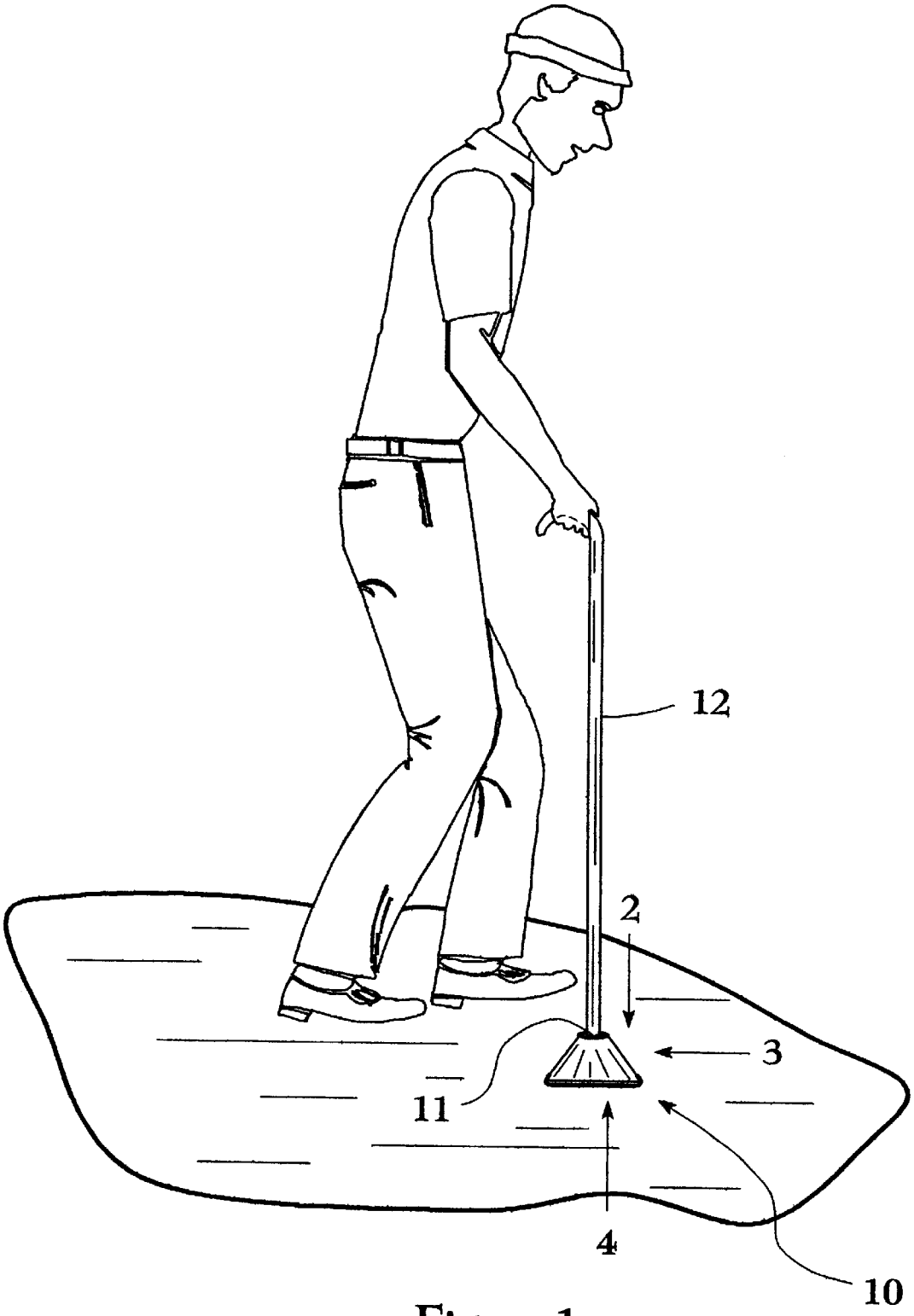
FIG. 1 is a diagrammatic perspective view of the present invention installed on a cane.
Figure 2:
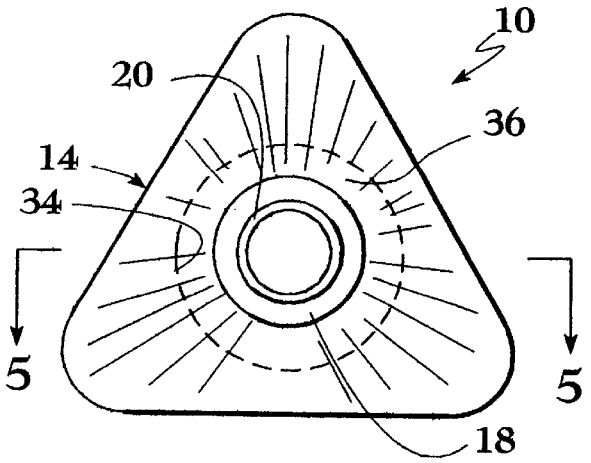
FIG. 2 is a diagrammatic top plan view taken generally in the direction of arrow 2 in FIG. 1.
Figure 4:
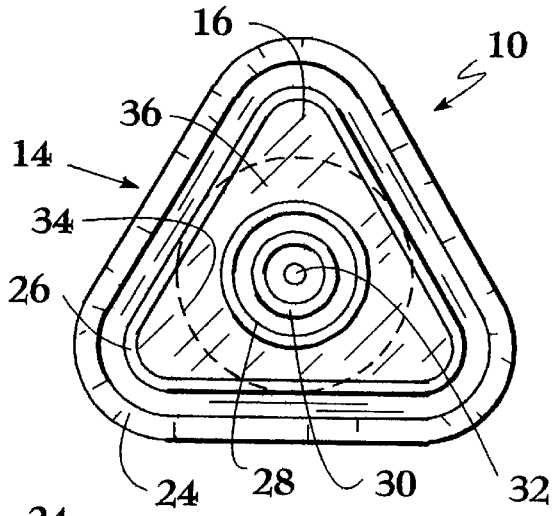
FIG. 4 is a diagrammatic bottom plan view taken generally in the direction of arrow 4 in FIG. 1.
Figure 5:
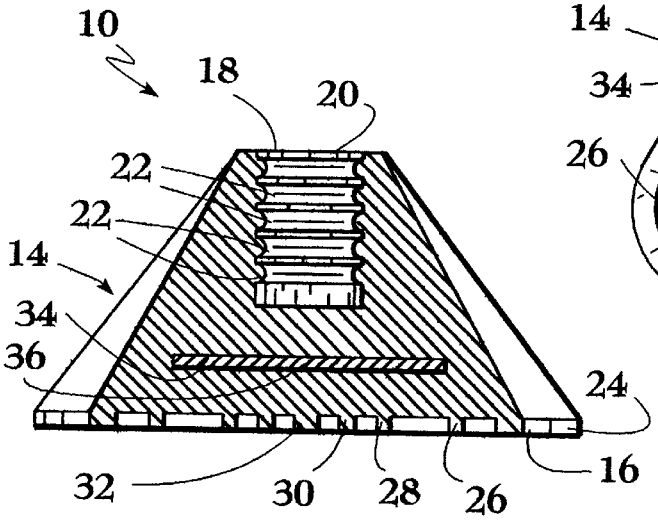
FIG. 5 is a cross sectional view taken on line 5—5 in FIG. 2.
Figure 3:
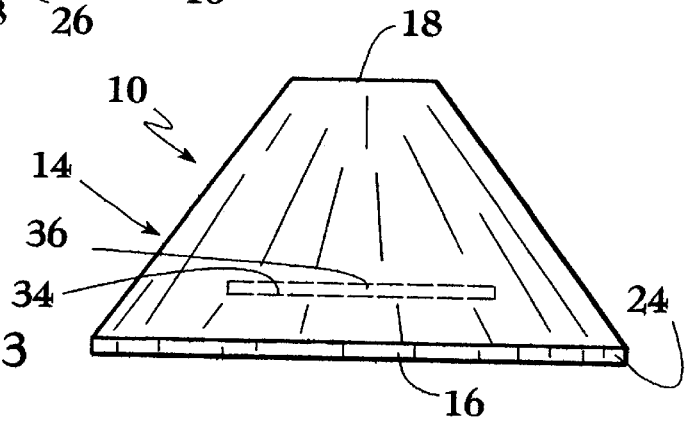
FIG. 3 is a diagrammatic side elevational view taken generally in the direction of arrow 3 in FIG. 1.

10 enlarged and weighted tip for replacing a multi-pod tip of a cane or the like of the present invention

11 lower end of cane 12
12 cane
14 body portion
16 base of body portion 14
18 top surface of body portion 14
20 bore in top surface 18 of body portion 14
22 plurality of rings lining bore 20 in top surface 18 of body portion 14
24 first tread on base 16 of body portion 14
26 second tread on base 16 of body portion 14
28 third tread on base 16 of body portion 14
30 fourth tread on base 16 of body portion 14
32 fifth tread on base 16 of body portion 14
34 cavity in body portion 14
36 plate

DESCRIPTION OF THE PREFERRED EMBODIMENT

Referring now to the figures in which like numerals indicate like parts, and particularly to FIG. 1, the enlarged and weighted tip for replacing a multi-pod tip of a cane or the like of the present invention is shown generally at 10 for receiving a lower end 11 of a cane 12 and for allowing the cane 12 to stand by itself.

The configuration of the enlarged and weighted tip for replacing a multi-pod tip of a cane or the like 10 can best be seen in FIGS. 2–5, and as such will be discussed with reference thereto.

The enlarged and weighted tip for replacing a multi-pod tip of a cane or the like 10 comprises a body portion 14 that is molded rubber and shaped like a frustrum of substantially a pyramid with a base 16 that is wide and triangular-shaped and a top surface 18 that is greatly narrower than the base 16 of the body portion 14 so as to allow the body portion 14 to provide a wide footprint while still being aesthetically upwardly tapering into the cane 12.

The top surface 18 of the body portion 14 has a bore 20 for receiving the lower end 11 of the cane 12, and which is tubular and depends axially therethrough, and terminates prior to the base 16 of the body portion 14.

The bore 20 in the top surface 18 of the body portion 14 is lined with a plurality of separate rings 22 that are elastomeric and axially spaced apart so as to form a generally corrugated configuration for maintaining different diametered canes 12 in the body portion 14 by providing firm frictional engagement while allowing the cane 12 to be deliberately removed therefrom.

The base 16 of the body portion 14 has a tread design thereon that comprises a plurality of concentric treads that provide greater suction and traction than conventional tips. The plurality of concentric treads comprise a first tread 24 that is triangular-ring-shaped and depends from the base 16 of the body portion 14, around its perimeter, a second tread 26 that is triangular-ring-shaped and depends from the base 16 of the body portion 14, inwardly of and concentric with the first tread 24 on the base 16 of the body portion 14, a third tread 28 that is circular-ring-shaped and depends from the base 16 of the body portion 14, inwardly of and concentric with the second tread 26 on the base 16 of the body portion 14, a fourth tread 30 that is circular-ring-shaped and depends from the base 16 of the body portion 14, inwardly of and concentric with the third tread 28 on the base 16 of the body portion 14, and a fifth tread 32 that is circular-shaped and depends from the base 16 of the body portion 14, centrally thereof.

The body portion 14 further has a cavity 34 therein that is disk-shaped and disposed axially between the bore 20 in the top surface 18 of the body portion 14 and the base 16 of the body portion 14, parallel thereto.

The enlarged and weighted tip for replacing a multi-pod tip of a cane or the like 10 further comprises a plate 36 that is metal and disk-shaped and completely fills the cavity 34 in the body portion 14 and provides structural integrity, prevents rupturing of the base 16 of the body portion 14, and adds sufficient weight to lower the center of gravity enabling the cane 12 to stand by itself.

It will be understood that each of the elements described above, or two or more together, may also find a useful application in other types of constructions differing from the types described above.

While the invention has been illustrated and described as embodied in an enlarged and weighted tip for replacing a multi-pod tip of a cane or the like, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A tip for a cane having a lower end, said tip comprising:

a body portion having a lower base portion, an upper portion smaller than said lower base portion and provided with a bore for receiving and holding the lower end of the cane, and means for permitting the cane to be self-standing, said body portion having a shape substantially forming a pyramidal frustum.

2. A tip for a cane according to claim 1, wherein:

at least one elastomeric ring is provided about said bore, said at least one elastomeric ring for frictionally engaging the end of the cane, yet permitting the cane to be deliberately removed therefrom.

3. A tip for a cane according to claim 2, wherein:

a plurality of axially spaced-apart elastomeric rings are provided about said bore, said plurality of elastomeric rings permitting a range of differently diametered cane ends to be frictionally engaged in said bore and deliberately removed therefrom.

4. A tip for a cane according to claim 1, wherein:

said base portion has a substantially triangular shape.

5. A tip for a cane according to claim 1, wherein:

said base portion includes a lower surface having a tread design which includes a plurality of concentric treads that provides at least one of suction and traction.

6. A tip for a cane according to claim 1, wherein:

said base portion includes at least one peripheral triangular-shaped tread.

7. A tip for a cane according to claim 1, wherein:

said base portion includes at least one tread which is triangular and at least one tread which is circular.

8. A tip for a cane according to claim 1, wherein:

said means for permitting the cane to be self-standing includes a weight provided in said base portion to impart a sufficiently low center of gravity to the cane.

9. A tip for a cane according to claim 8, wherein:

said weight is a metal plate.

10. A tip for a cane according to claim 1, wherein:

said base portion includes a lower surface, and a means for structurally strengthening said body portion is provided in said body portion between said bore and said lower surface.

11. A tip for a cane according to claim 1, wherein:

said body portion is comprised of a molded elastomeric substance.

12. A tip for a cane having a lower end, said tip comprising:

a body portion having a shape of a substantially pyramidal frustum, the body portion having a lower surface and an upper surface smaller than said lower surface and provided with a bore for receiving and holding the lower end of the cane.

13. A tip for a cane according to claim 12, wherein:

said shape is substantially a three-sided pyramidal frustum.

14. A cane, comprising:

a) an elongate shaft having a handle portion and a lower end opposite said handle portion; and b) a tip having a body portion including a lower base portion, an upper portion smaller than said lower base portion and provided with a bore which receives and holds said lower end of said shaft, and means for permitting said cane to be self-standing, said body portion having a shape substantially forming a frustum.

15. A cane according to claim 14, wherein:

said body portion is provided with a shape of a substantially pyramidal frustum.

16. A cane according to claim 14, wherein:

at least one elastomeric ring is provided about said bore which frictionally engages said end of said shaft, yet permits said end of said shaft to be deliberately removed therefrom.

17. A cane according to claim 14, wherein:

said base portion has a substantially triangular shape.

18. A cane according to claim 14, wherein:

said base portion includes a lower surface having a tread design which includes a plurality of concentric treads that provides at least one of suction and traction.

19. A cane according to claim 14, wherein:

said base portion includes at least one peripheral triangular-shaped tread.

20. A cane according to claim 14, wherein:

said base portion includes at least one tread which is triangular and at least one tread which is circular.

21. A cane according to claim 14, wherein:

said means for permitting said cane to be self-standing includes a weight provided in said base portion to impart said cane with a sufficiently low center of gravity.

22. A cane according to claim 21, wherein:

said weight is a metal plate.

23. A cane according to claim 14, wherein:

said base portion includes a lower surface, and a means for structurally strengthening said body portion is provided in said body portion between said bore and said lower surface.

24. A cane to assist a user in walking on a ground surface, comprising:

a) an elongate shaft having a handle portion and a lower end opposite said handle portion; and b) a tip having a body portion provided with a shape of a substantially pyramidal frustum and a bore which receives and holds said lower end of said shaft, said body portion defining a lower base for contacting the ground surface and an upper surface smaller than said lower base and provided with said bore.

25. A cane according to claim 24, wherein:

said shape is substantially a three-sided pyramidal frustum.

* * * * *